US009624696B2

(12) United States Patent
Clifford et al.

(10) Patent No.: US 9,624,696 B2
(45) **Date of Patent: *Apr. 18, 2017**

(54) LOCK PLUG INCLUDING MODULAR CARTRIDGES

(71) Applicant: Schlage Lock Company LLC, Indianapolis, IN (US)

(72) Inventors: Jason Curtis Clifford, Colorado Springs, CO (US); Evan Earl Evans, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/296,308

(22) Filed: Jun. 4, 2014

(65) Prior Publication Data

US 2015/0354246 A1 Dec. 10, 2015

(51) Int. Cl.

| | |
|---|---|
| ***E05B 63/00*** | (2006.01) |
| ***E05B 29/00*** | (2006.01) |
| *E05B 9/08* | (2006.01) |

(52) U.S. Cl.

CPC ..... *E05B 63/0056* (2013.01); *E05B 29/0033* (2013.01); *E05B 9/088* (2013.01)

(58) Field of Classification Search

CPC .... E05B 29/00; E05B 27/0003; E05B 27/086; E05B 21/066; E05B 9/084; E05B 9/086; E05B 17/0004; E05B 27/005; E05B 29/0033; E05B 63/0056; E05B 9/088; Y10T 29/49828; Y10T 70/8432

USPC ..... 70/492, 495, 496, 376, 377, 367–372, 70/382–384

See application file for complete search history.

(56) References Cited

U.S. PATENT DOCUMENTS

| | | | | |
|---|---|---|---|---|
| 1,905,639 | A | 4/1933 | Jacobi | |
| 2,358,164 | A * | 9/1944 | Honger | 70/342 |
| 2,603,081 | A * | 7/1952 | Pelle | 70/382 |
| 2,766,611 | A * | 10/1956 | Hagel | 70/492 |
| 3,149,486 | A | 9/1964 | Russell et al. | |
| 3,808,854 | A * | 5/1974 | Mercurio | 70/419 |
| 4,015,458 | A | 4/1977 | Mercurio | |
| 4,077,240 | A * | 3/1978 | Crasnianski | 70/360 |

(Continued)

OTHER PUBLICATIONS

"axial." Merriam-Webster.com. 2006. http://www.merriam-webster.com/dictionary/axial.*

(Continued)

*Primary Examiner* — Suzanne Barrett
*Assistant Examiner* — Amanda L Miller
(74) *Attorney, Agent, or Firm* — Taft Stettinius & Hollister LLP

(57) ABSTRACT

An exemplary locking cartridge includes a generally cylindrical housing, first and second plates, and a sliding member. The plates are rotatable with respect to the housing, and at least one of the plates is movable in the axial direction of the housing. The housing and the movable plate include cam surfaces that interact to cause the movable plate to move toward the other plate when the movable plate is rotated. The sliding member is slidingly coupled to one of the plates and operable in a blocked state in which the sliding member resists axial motion of the movable plate, and an unblocked state in which the sliding member does not resist axial motion of the movable plate.

19 Claims, 7 Drawing Sheets

(56) References Cited

U.S. PATENT DOCUMENTS

| | | | | |
|---|---|---|---|---|
| 4,655,062 | A | 4/1987 | Kaufman | |
| 4,729,231 | A | 3/1988 | Wu et al. | |
| 5,168,734 | A * | 12/1992 | Duval et al. | 70/369 |
| 5,687,594 | A | 11/1997 | Wang | |
| 5,964,107 | A | 10/1999 | Chang | |
| 6,301,942 | B1 | 10/2001 | Shvarts | |
| 6,523,382 | B1 * | 2/2003 | Dimig | C23C 16/455 70/419 |
| 6,912,881 | B2 | 7/2005 | Kleinhaeni | |
| 7,225,651 | B2 | 6/2007 | Edwards et al. | |
| 7,634,931 | B2 | 12/2009 | Segien et al. | |
| 8,336,349 | B2 | 12/2012 | Thimmappa et al. | |
| 9,021,843 | B2 * | 5/2015 | Zuraski et al. | 70/358 |
| 9,447,608 | B2 * | 9/2016 | Clifford | E05B 27/0003 |
| 2003/0154753 | A1 * | 8/2003 | Dimig et al. | 70/495 |
| 2012/0031156 | A1 | 2/2012 | Wheatland | |

OTHER PUBLICATIONS

"axis." Merriam-Webster.com. 2006. http://www.merriam-webster.com/dictionary/axis.*

* cited by examiner

LOCK PLUG INCLUDING MODULAR CARTRIDGES

TECHNICAL FIELD

The present invention generally relates to locks, and more particularly, but not exclusively, to cylinder locks.

BACKGROUND

Lock cylinders, particularly those of the interchangeable core variety, have complex part tolerances and pinning to allow the cylinder to function properly. The complexities can also make the pinning process difficult and laborious. If pinning is off, the entire assembly must be reset and emptied, and the user must start over. Furthermore, many traditional interchangeable core assemblies suffer from a tendency to "explode" when the plug is removed from the shell. That is to say, the springs eject the internal components out of the assembly, thereby losing the pinning placement and running the risk of damaging, destroying, or losing one or more components. Therefore, a need remains for further improvements in lock cylinder assemblies.

SUMMARY

One embodiment of the present invention is a unique locking plug formed of modular cartridges. Further embodiments, forms, features, and aspects of the present application shall become apparent from the description and figures provided herewith.

DETAILED DESCRIPTION OF ILLUSTRATIVE EMBODIMENTS

Figure 1:
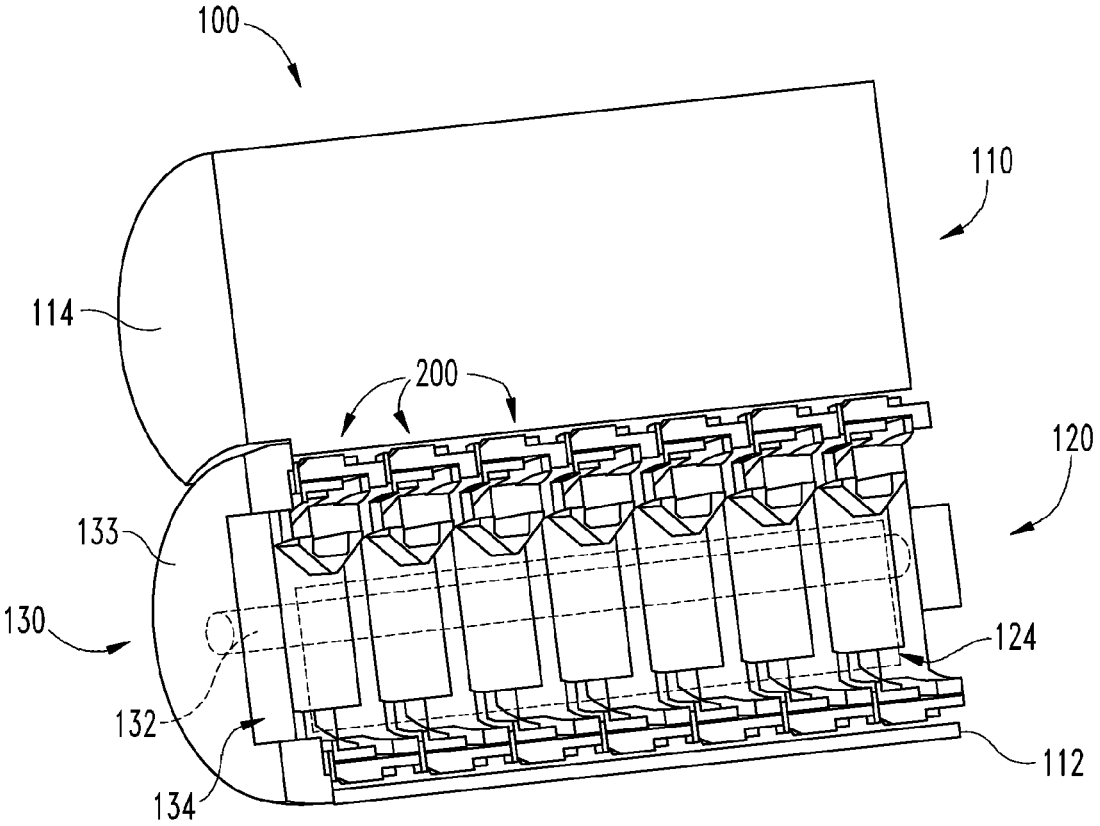
FIG. 1 is a first cutaway view of a locking device according to one embodiment.

For the purposes of promoting an understanding of the principles of the invention, reference will now be made to the embodiments illustrated in the drawings and specific language will be used to describe the same. It will nevertheless be understood that no limitation on the scope of the invention is hereby intended. Any alterations and further modifications in the described embodiments, and any further applications of the principles of the invention as described herein are contemplated as would normally occur to one skilled in the art to which the invention relates.

Figure 6:
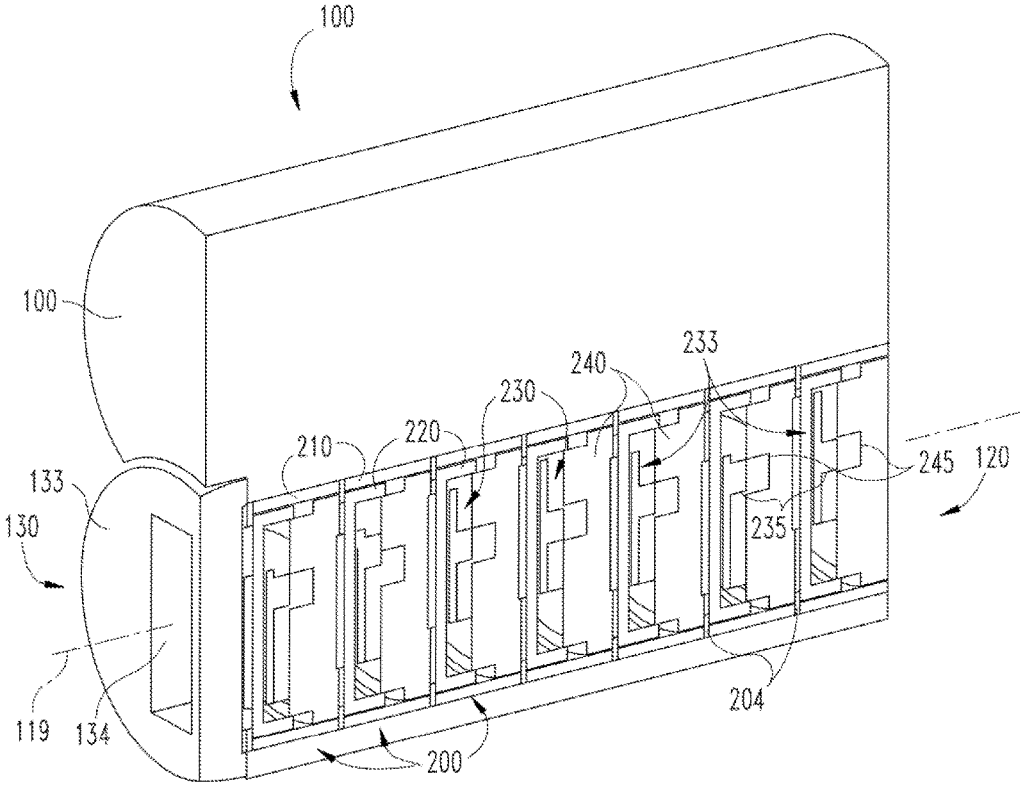
FIG. 6 is a second cutaway view of the locking device illustrated in FIG. 1.

With reference to FIG. 1, an illustrative cylinder 100 includes a shell 110 and a plug 120. Shell 110 includes a generally cylindrical chamber 112 in which the plug 120 is positioned, and which extends along a longitudinal axis 119 (FIG. 6). Shell 110 may further include a tower 114 configured to allow the cylinder 100 to be installed into an existing cylinder housing (not shown). In the illustrated embodiment, the tower 114 is configured such that the cylinder 100 is of the small format interchangeable core (SFIC) type. It is also contemplated that the shell 110 may be configured such that the cylinder 100 is of another format, such as full size, large format, mortise, rim, or key-in-knob/lever. It is further contemplated that the shell 110 may be towerless.

The plug 120 is disposed within the chamber 112, extends along the axis 119 (FIG. 6), and comprises a mounting device 130 and a plurality of the cartridges 200. The cartridges 200 include passages that are substantially aligned such that a key passage 124 configured to receive the shank of a corresponding key is formed in the plug 120. In the illustrated embodiment, the plug 120 includes seven of the cartridges 200. As described in further detail below, it is also contemplated that more or fewer cartridges 200 may be utilized.

The mounting device 130 includes a faceplate 133 having formed therein a keyway 134. The keyway 134 is aligned with the key passage 124, and may include a ward (not shown) configured to prevent insertion of a key which does not have a correspondingly-shaped groove. In the illustrated form, the mounting device 130 includes at least one rod 132 extending in the axial direction of the plug 120, the function of which is described in detail below.

Figure 3:
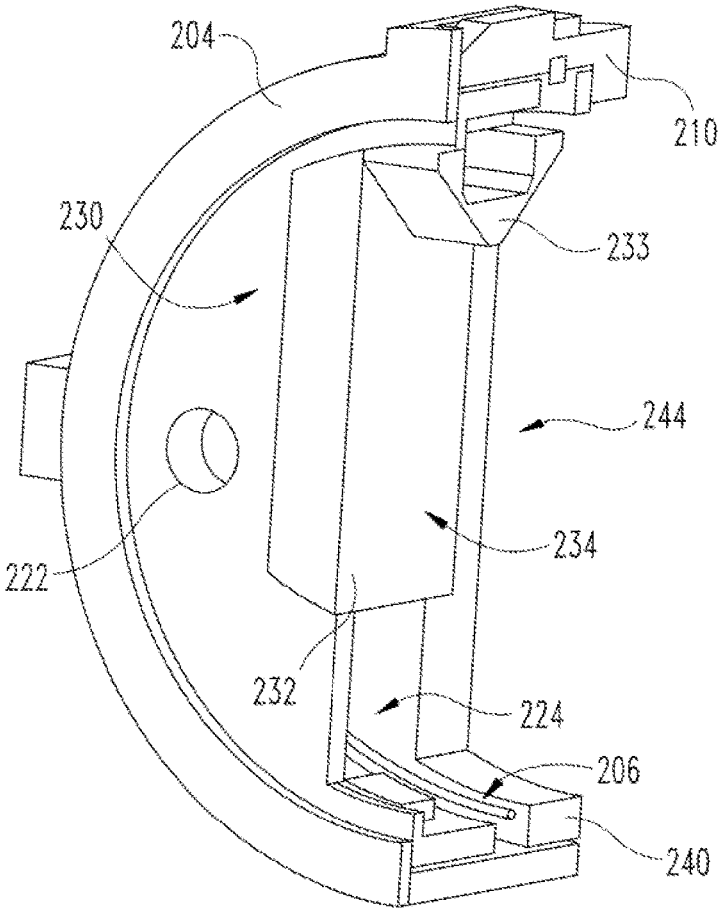
FIG. 3 is a first cutaway view of the cartridge illustrated in FIG. 2.
Figure 4:
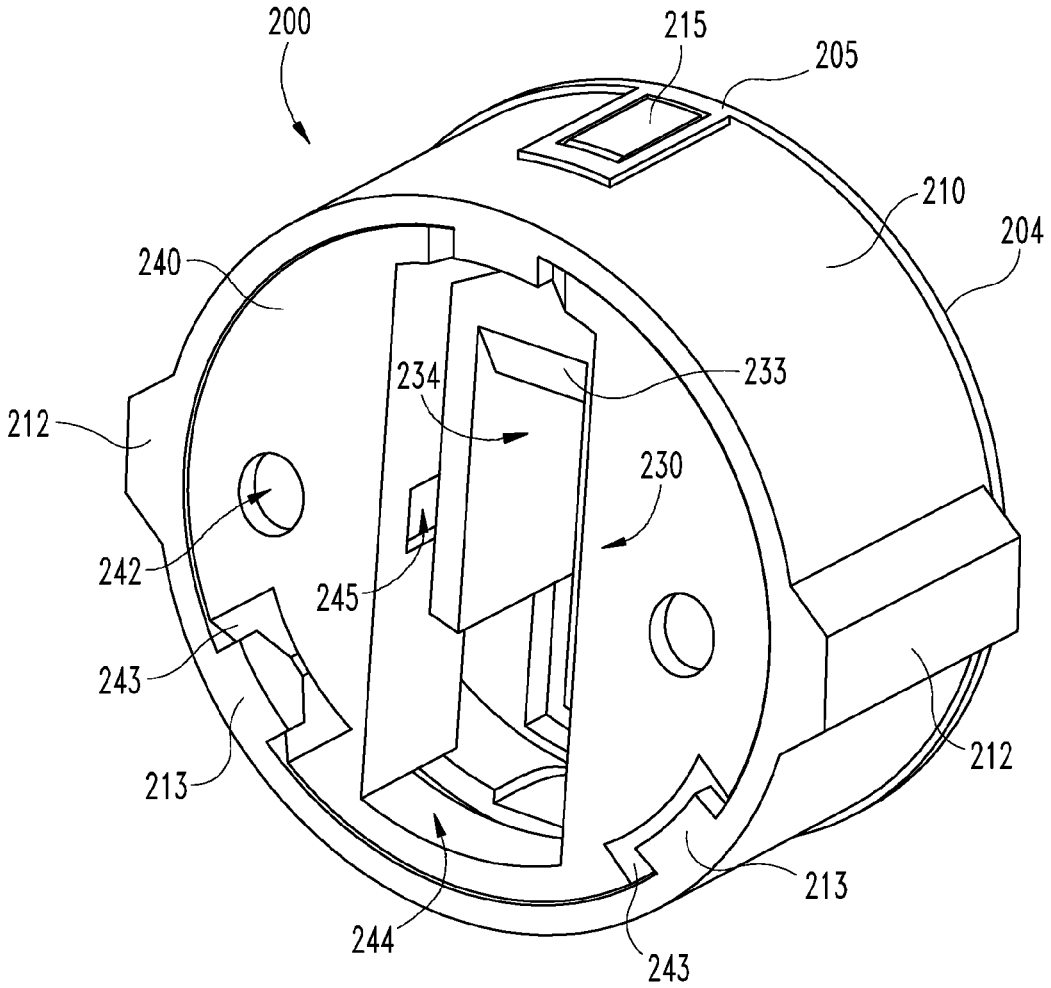
FIG. 4 is a perspective view of the second side of the cartridge illustrated in FIG. 2.
Figure 5:
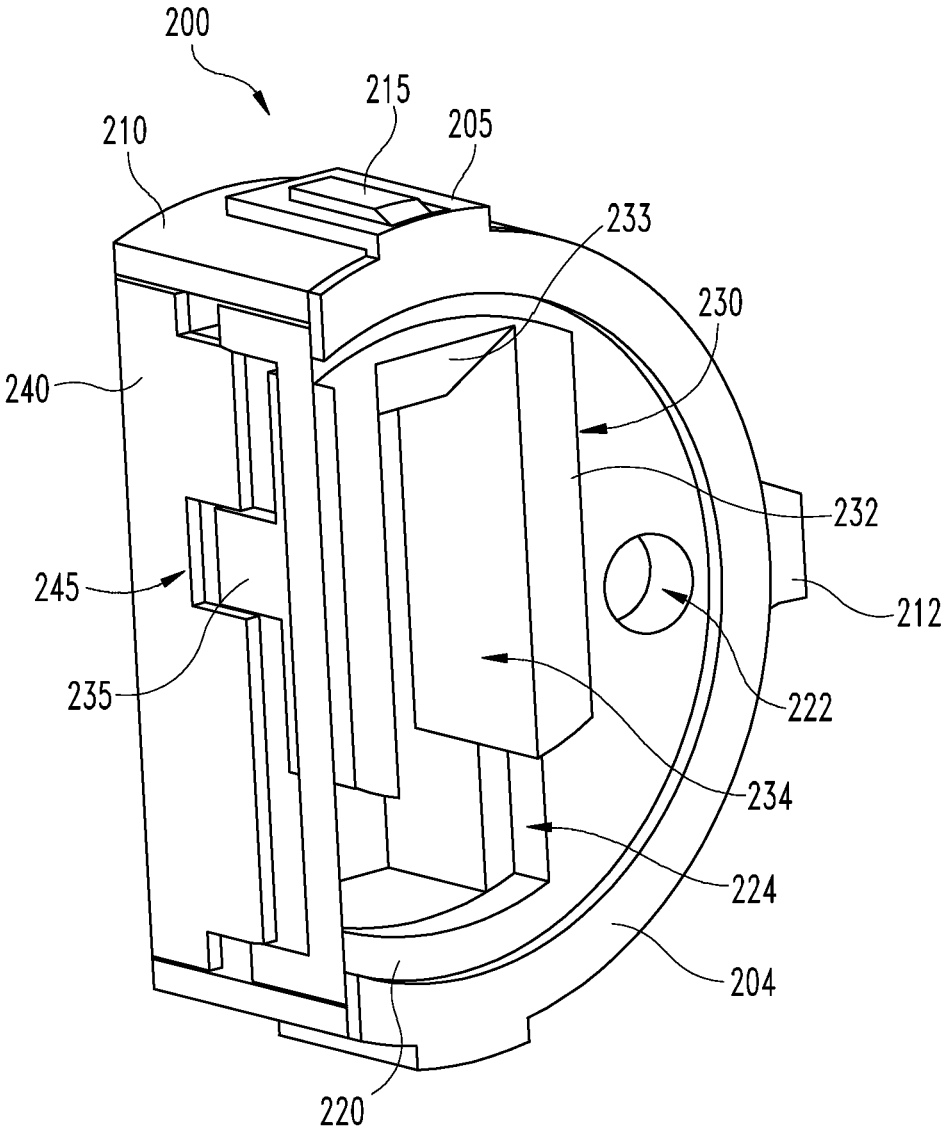
FIG. 5 is a second cutaway view of the cartridge illustrated in FIG. 2.

With additional reference to FIGS. 4 and 5, the housing 210 includes tapered protrusions 213 which are received in correspondingly-shaped tapered recesses 243 formed on the movable plate 240. The tapered protrusions 213 and the tapered recesses 243 are configures as cam surfaces that cause axial displacement of the movable plate 240 in response to angular displacement of the movable plate 240. In other words, rotation of the movable plate 240 with respect to the housing 210 urges the movable plate 240 to cam axially inward toward the fixed plate 220. The cartridge 200 may further include a biasing member 206 (FIG. 3) configured to urge the movable plate 240 into an angular position in which the tapered protrusions 213 are received within the corresponding tapered recesses 243.

Figure 2:
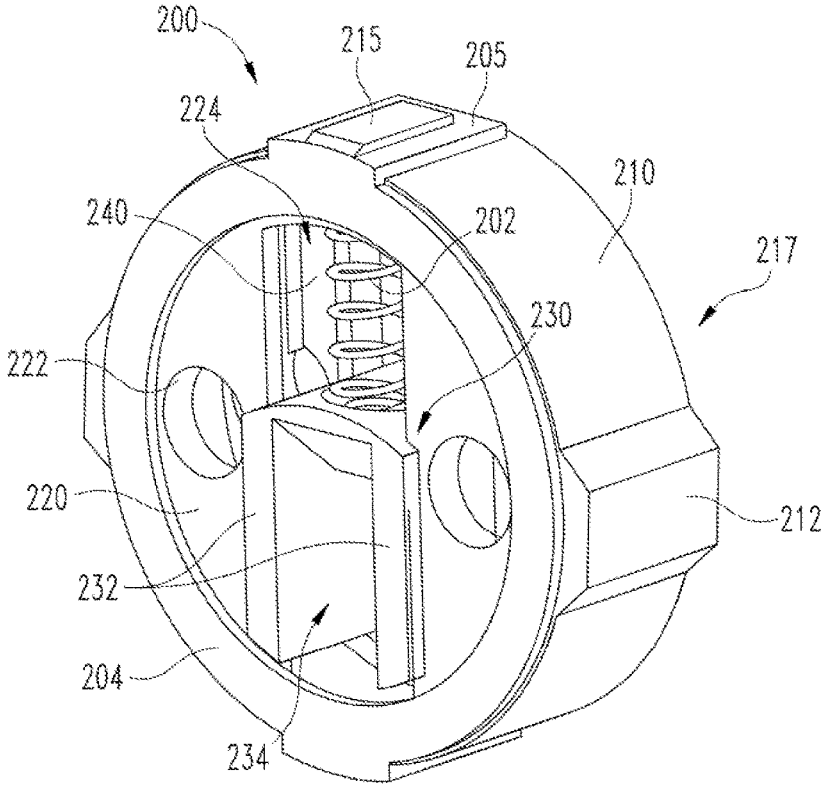
FIG. 2 is a perspective view of a first side of a cartridge according to one embodiment.
Figure 7:
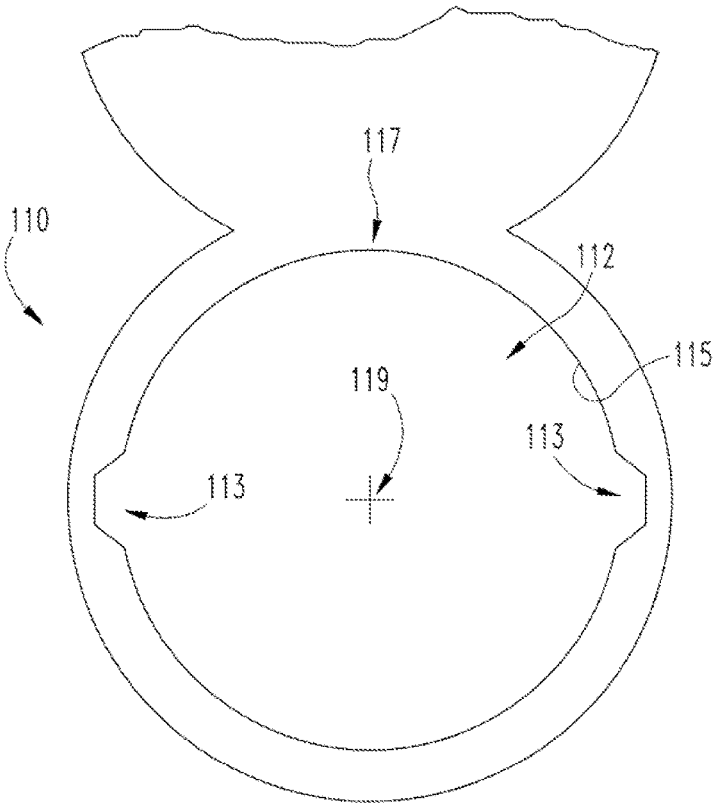
FIG. 7 is a cross-sectional illustration of the shell illustrated in FIG. 1.

The housing 210 is generally cylindrical and includes protrusions 212, each of which is configured to be received in a corresponding groove 113 formed in the inner surface 115 of the shell 110 (FIG. 7), such that the housing 210 is not rotatable with respect to the shell 110. In the illustrated form, the protrusions 212 provide the housing 210 with a non-circular outer perimeter 217 (FIG. 2), and the grooves 113 provide the chamber 112 with a corresponding non-circular cross-section 117 (FIG. 7). In other embodiments, the protrusions may instead be formed in the shell 110, and a correspondingly-shaped groove may be formed on the housing 210. The retaining ring 204 is configured to retain the fixed plate 220 and the movable plate 240 within the housing 210. In the illustrated embodiment, the retaining ring 204 is releasably coupled to the housing 210 by a collar 205 which engages a protrusion 215. It is also contemplated that the retaining ring 204 may be releasably coupled to the housing 210 in another manner, and/or that the retaining ring 204 may be fixedly coupled to the housing 210. In certain embodiments, the retaining ring 204 may be considered to form a portion of the housing 210.

The fixed plate 220 is disposed within the housing 210 such that the fixed plate 220 is rotatable with respect to the housing 210, but is not movable in the axial direction of the housing 210. In other words, the fixed plate 220 has a variable angular position and a fixed axial position within the housing 210. The fixed plate 220 includes through-holes 222, each of which is configured to receive one of the rods 132. The fixed plate 220 also includes an elongated channel 224 configured to receive the sliding member 230.

The sliding member 230 is slidingly coupled to the fixed plate 220 and is disposed partially within the channel 224. The sliding member 230 includes legs 232 and an engagement surface 233. The legs 232 are horizontally separated from one another by a distance corresponding to the width of a corresponding key such that a passage 234 is formed therebetween. While the illustrated sliding member 230 includes two legs 232, in other forms the sliding member 230 may include only one leg 232. The sliding member 230 is urged downward (with reference to the illustrated orientation) via the biasing member 202. When no key is inserted, the legs 232 may be urged into contact with a surface of the cartridge 200 opposite the biasing member 202. The passage 234 is configured to receive the shank of a corresponding key, and the engagement surface 233 is configured to travel along the teeth of the key as the shank is inserted. The engagement surface 233 may be tapered or curved to facilitate such travel. The opposing forces provided by the biasing member 202 and the shank ensure that the vertical position of the sliding member 230 corresponds to the root depth of the shank at the point of contact.

In the illustrated embodiment, the engagement surface 233 is configured to engage teeth defined by an uppermost surface of a corresponding (e.g. top-cut) key. In other embodiments, one or more engagement surfaces 233 may be configured to engage another type of key bitting such as dimple pinning, side-milling, or side notching. For example, one of the legs 232 may include a protrusion extending into the passage 234 and configured to interact with a cut on the side of the key. In certain embodiments, the plug 120 may include a first set of cartridges configured to engage top-cut bittings, and a second set of cartridges configured to engage side-millings.

The movable plate 240 is disposed within the housing 210 such that the movable plate 240 is rotatable with respect to the housing 210 and is movable in the axial direction of the housing 210. In other words, the movable plate 240 has variable axial and angular positions relative to the housing 210. In the illustrated embodiment, each fixed plate 220 is positioned between the faceplate 133 and the corresponding movable plate 240. It is also contemplated that the orientation of one or more of the cartridges 200 may be reversed such that the fixed plate 220 is positioned between the faceplate 133 and the corresponding movable plate 240. The movable plate 240 includes a passage 244 which is substantially aligned with the passages 224, 234, the combination of which defines a section of the key passage 124. When multiple cartridges 200 are combined to form the plug 120, the passages 224, 234, 244 of each cartridge 200 are substantially aligned with the keyway 134 such that when the shank of a key is inserted into the keyway 134, the shank is free to travel through the key passage 124. In some embodiments, the sliding member 230 may be partially disposed within the passage 244. The movable plate 240 also includes through-holes 242 which are aligned with the through-holes 222 and are each configured to receive one of the rods 132.

To form the plug 120, the cartridges 200 are mounted on the mounting device 130 by inserting the rods 132 into the through-holes 222, 242 such that the mounting device 130 is rotationally coupled to the cartridge 200. When the selected number of the cartridges 200 have been mounted, the plug 120 is inserted into the chamber 112. The plug 120 may further include a cap (not illustrated) configured to prevent the cartridges 200 from sliding off the rods 132. The plug 120 may further comprise a rear plate (not illustrated) configured to interact with a throwing device operable to move a latch, bolt, or other locking element between a locked position and an unlocked position. In other embodiments, the throwing device may connect to the rods 132 or a plate 220, 240. It is also contemplated that the plug 120 may throw the latch, bolt, or other locking element in another manner.

In the illustrated embodiment, each of the plates 220, 240 includes two through-holes corresponding to the two rods 132 of the mounting device 130. It is also contemplated that more or fewer rods 132 may be utilized, and that the fixed plate 220 and the movable plate 240 may include a corresponding number of through-holes. It is further contemplated that the cartridges 200 may be coupled to the mounting device 130 in another manner, or that the cartridges 200 may be coupled only to the shell 110.

With additional reference to FIGS. 4 and 5, the housing 210 includes tapered protrusions 213 which are received in correspondingly-shaped tapered recesses 243 formed on the movable plate 240. The tapered protrusions 213 and the tapered recesses 243 are configures as cam surfaces that cause axial displacement of the movable plate 240 in response to angular displacement of the movable plate 240. In other words, rotation of the movable plate 240 with respect to the housing 210 urges the movable plate 240 to cam axially inward toward the fixed plate 220. The cartridge 200 may further include a biasing member (not illustrated) configured to urge the movable plate 240 into an angular position in which the tapered protrusions 213 are received within the corresponding tapered recesses 243.

In the illustrated embodiment, the cam surfaces on the housing 210 are configured as the tapered protrusions 213, and the cam surfaces on the movable plate 240 are configured as the tapered recesses 243. However, in other embodiments, the movable plate 240 may include one or more tapered protrusions, and the housing 210 may include correspondingly-shaped recesses. Furthermore, while the illustrated cam surfaces are both tapered in a substantially rectilinear manner, it is also contemplated that one or more of the cam surfaces may be of a different geometry so long as the interaction of the cam surfaces urges the movable plate 240 toward the fixed plate 220 upon rotation of the movable plate 240. By way of non-limiting example, one or more of the cam surfaces may include a curvilinear geometry. It is also contemplated that the cam surfaces may be formed on the retaining ring 204 in addition to or in lieu of cam surfaces formed on the housing 210. In such embodiments, the retaining ring 204 would be positioned on the same side of the cartridge 200 as the movable plate 240.

In the illustrated form, the cartridge 200 includes one fixed plate 220 and one movable plate 240. However, in other embodiments, a cartridge 200 may include two movable plates 240, and both the retaining ring 204 and the housing 210 may include cam surfaces such as the tapered protrusions 213. In such embodiments, the cam surfaces incorporated into the retaining ring 204 interact with the first movable plate, and the cam surfaces incorporated into the housing 210 interact with the second movable plate, and the movable plates cam axially inward toward one another when rotated.

The sliding member 230 includes an interference protrusion 235, and the movable plate 240 includes a correspondingly-shaped recess 245 configured to receive the interference protrusion 235. When the sliding member 230 is not in the proper position, the movable plate 240 comes into contact with the protrusion 235 upon rotation of the plates 220, 240. In such a blocked position, the fixed plate 220 and the sliding member 230 provide a stationary plane which resists further axial movement of the movable plate 240. In other words, the protrusion 235 interferes with the axial movement of the movable plate 240, and further rotation of the movable plate 240 with respect to the housing 210 is prevented. When the sliding member 230 is in the proper position, the protrusion 235 is aligned with the recess 245. In such an unblocked state, the movable plate 240 is free to move toward the fixed plate 220, and rotation of the movable plate 240 with respect to the housing 210 may continue.

In the cartridge 200 depicted in FIGS. 4 and 5, the movable plate 240 includes a single recess 245, and the movable plate 240 is rotatable with respect to the housing 210 at only a single position of the sliding member 230. The movable plate 240 of one or more of the other cartridges 200 in the plug 120 may include two or more of the recesses 245 (as illustrated in FIG. 6). In such cartridges 200, the movable plate 240 is rotatable with respect to the housing 210 at a number of positions of the sliding member 230 corresponding to the number of recesses 245.

In the illustrated cartridge 200, the protrusion 235 is formed on the sliding member 230, and the recess 245 is formed on the movable plate 240. However, in other embodiments, the movable plate 240 may include the protrusion, and the sliding member 230 may include the correspondingly-shaped recess. Furthermore, while the sliding member 230 is slidingly coupled to the fixed plate 220, it is also contemplated that the sliding member 230 may be slidingly coupled to the movable plate 240. In such embodiments, the interference protrusion can be provided on one of the sliding member and the fixed plate, and the correspondingly-shaped recess can be provided on the other of the sliding member and the fixed plate.

With additional reference to FIG. 6, when a key shank (not illustrated) is inserted into the key passage 124, the engagement surfaces 233 travel along the top cut of the key. When the shank is fully inserted, the position of each sliding member 230 is determined by the root depth of the shank at the corresponding bitting position. When the key is rotated, the shank engages the surfaces of the passages 244, either directly or through the legs 234 of the sliding member 230, and urges each plate 220, 240 to rotate. The tapered protrusions 213 interact with the tapered recesses 243, thereby urging each movable plate 240 toward the corresponding fixed plate 220. If the proper key has been inserted, each sliding member 230 is in the unblocked position, and each of the protrusions 235 is aligned with a corresponding recess 245. In such a case, each movable plate 240 is free to move toward the corresponding fixed plate 220, and further rotation of the key is not prevented or inhibited. If one or more sliding member 230 is in the blocked position, the protrusion 235 of that sliding member 230 prevents further axial movement of the corresponding movable plate 240, thereby preventing further rotation of the movable plate 240 and the key.

In the illustrated embodiment, the plug 120 has been master-keyed by providing the movable plate 240 of one cartridge with the two recesses 245. In other embodiments, two or more of the cartridges 200 may include the multiple recesses 245 such that multiple levels of master-keying are possible. It is also contemplated that the movable plate 240 of each cartridge 200 may include only a single recess 245 such that the plug is operable by only a single key formation. Furthermore, while the exemplary plug 120 includes seven cartridges 200, it is to be appreciated that the modular nature of the cartridges 200 allows for the plug 120 to be created along any desired length by selecting the appropriate number of cartridges 200. Because the cartridges 200 are interchangeable and essentially self-contained, they may be used across a variety of formats simply by selecting an appropriate configuration of the shell 110. Furthermore, the fact that each of the modular cartridges 200 corresponds to a single bitting position of the key enables the user to create a lock cylinder with pinning options and cylinder length according to his or her particular needs.

The modular nature of the cartridges 200 also facilitates manufacture and maintenance. During manufacture, pinning the plug 120 can be handled in subassemblies prior to cylinder production. The plug 120 can also be easily re-pinned by replacing one or more of the cartridges 200, or by simply altering the order of the cartridges 200 within the plug 120. This reduces time and complexity from the pinning process, thereby enabling simplified re-pinning of the cylinder 100 whether in a manufacturing setting or in the field. In certain forms, the cartridges 200 may be labeled with a code corresponding to the root depth (or depths if the cartridge includes the multiple recesses 245) of a key which will cause the protrusion 235 to align with a recess 245. Given the bitting code of a particular key, a user can easily select and install the cartridges 200 which will enable the cylinder 100 to be operated by the key.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

a shell comprising an inner surface, wherein the inner surface defines a plug chamber having a non-circular cross-section, wherein the plug chamber extends along a longitudinal axis, and wherein the longitudinal axis defines opposite axial directions;

a plug assembly seated in the plug chamber, the plug assembly including a plurality of cartridges, each cartridge including:

a generally cylindrical housing including a first cam surface, wherein the housing includes an outer surface having a non-circular outer perimeter, wherein the non-circular outer perimeter of the housing corresponds to the non-circular cross-section of the plug chamber, and wherein engagement between the outer surface of the housing and the inner surface of the shell prevents rotation of the housing with respect to the shell;

a first plate positioned at least partially within the housing and including a first plate passage and a second cam surface, wherein the first and second cam surfaces are configured to cause axial displacement of the first plate along the longitudinal axis with respect to the housing in response to angular displacement of the first plate about the longitudinal axis with respect to the housing;

a second plate including a second plate passage generally aligned with the first plate passage; and a sliding member slidingly coupled to one of the first plate and the second plate and operable in a blocked state wherein the sliding member resists axial motion of the first plate along the longitudinal axis and an unblocked state wherein the sliding member does not resist axial motion of the first plate along the longitudinal axis.

2. The system of claim 1, wherein one of the first cam surface and the second cam surface includes a tapered protrusion, the other of the first cam surface and the second cam surface includes a tapered recess configured to receive the tapered protrusion, and wherein the protrusion and the recess cause the axial displacement along the longitudinal axis as a result of the angular displacement about the longitudinal axis.

3. The system of claim 1, wherein one of the sliding member and the first plate includes a protrusion, the other of the sliding member and the first plate includes a recess configured to receive the protrusion, and wherein the unblocked state is defined by a position of the sliding member in which the protrusion and the recess are generally aligned.

4. The system of claim 3, wherein the sliding member includes an engagement surface configured to interact with a key surface to adjust the position of the sliding member within the cartridge.

5. The system of claim 1, further comprising a mounting device including:

a faceplate having a keyway; and a rod extending from the faceplate in the axial direction and positioned at least partially within a first through-hole formed in the first plate and a second through-hole formed in the second plate.

6. The system of claim 5, further wherein the rod is positioned at least partially within the first through-hole and the second through-hole of each cartridge.

7. The system of claim 6, wherein the mounting device is rotatable with respect to the housings when each of the sliding members is in the unblocked position, and wherein the mounting device is not rotatable with respect to the housings when at least one of the sliding members is not in the unblocked position.

8. The system of claim 7, wherein each sliding member includes an engagement surface configured to interact with a key surface to adjust the position of the sliding member, and wherein the engagement surface of each sliding member is not aligned with the engagement surface of another of the sliding members in a state in which each sliding member is in the unblocked position.

9. The system of claim 1, wherein the second plate has a fixed axial position along the longitudinal axis with respect to the housing.

10. An apparatus, comprising:

a shell comprising a plug chamber having a non-circular cross-section, wherein the plug chamber extends along a longitudinal axis, and wherein the longitudinal axis defines opposite axial directions; and a plug assembly seated in the plug chamber, the plug assembly including a plurality of cartridges, each cartridge including a housing, a fixed plate, a movable plate, and a sliding member;

wherein the housing has an outer perimeter corresponding to the non-circular cross-section of the plug chamber, wherein the outer perimeter and the non-circular cross-section are structured to prevent rotation of the housing with respect to the shell;

wherein the fixed plate and the movable plate are axially offset from one another along the longitudinal axis;

wherein the fixed plate has a fixed axial position along the longitudinal axis within the housing, is rotatable about the longitudinal axis with respect to the housing, and includes a first radial passage;

wherein the movable plate has a variable axial position along the longitudinal axis within the housing, is rotatable about the longitudinal axis with respect to the housing, and includes a second radial passage;

wherein one of the housing and the movable plate includes a first protrusion, the other of the housing and the movable plate includes a first recess configured to receive the first protrusion, the first protrusion and the first recess are configured to axially urge the movable plate along the longitudinal axis toward the fixed plate upon rotation of the movable plate about the longitudinal axis;

wherein the sliding member includes a first portion of a first geometry, is slidingly coupled to one of the fixed plate and the movable plate, and the other of the fixed plate and the movable plate includes a second portion of a second geometry;

wherein one of the first geometry and the second geometry comprises a second protrusion, the other of the first geometry and the second geometry comprises a second recess configured to receive the second protrusion; and wherein the sliding member is operable in a first radial position in which the second protrusion is not aligned with the second recess and axial movement of the movable plate along the longitudinal axis is prevented, and a second radial position in which the second protrusion is aligned with the second recess and axial movement of the movable plate along the longitudinal axis is not prevented.

11. The apparatus of claim 10, wherein the second geometry further comprises a third recess configured to receive the second protrusion.

12. The apparatus of claim 10, each cartridge further comprising a biasing member configured to urge the sliding member along the radial passage of the plate to which the sliding member is coupled.

13. The apparatus of claim 10, each cartridge further comprising a biasing member configured to urge the movable plate to an angular position in which the first protrusion is aligned with the first recess.

14. The apparatus of claim 10, wherein, for each cartridge, the housing includes a retaining disc configured to resist axial movement of the fixed plate along the longitudinal axis.

15. The apparatus of claim 10, wherein, for each cartridge, the fixed plate has a first through-hole, the movable plate has a second through-hole aligned with the first through-hole, and the apparatus further comprising a faceplate including a third radial passage generally aligned with the first and second radial passages, and a rod passing through the first and second through-holes.

16. The apparatus of claim 15, wherein the third radial passage is generally aligned with the first and second radial passages of each cartridge, and the rod passes through the first and second through-holes of each cartridge.

17. A method, comprising:

forming a lock plug assembly having a longitudinal axis, the lock plug assembly comprising a faceplate and a plurality of cartridges, each cartridge including a housing, a first disc which is rotatable about the longitudinal axis with respect to the housing, a second disc configured to move axially along the longitudinal axis toward the first disc when the second disc is rotated about the longitudinal axis with respect to the housing, and a slider operable to selectively prevent and allow axial movement of the second disc, the forming including mounting the cartridges to the faceplate by:

aligning a first passageway formed in the first disc and a second passageway formed in the second disc with a third passageway formed in the faceplate; and passing a rod coupled to the faceplate through a first hole formed in the first disc and a second hole formed in the second disc, wherein the rod extends parallel to the longitudinal axis; and installing the lock plug assembly in a shell having a plug chamber, wherein installing the lock plug assembly includes sliding the lock plug assembly into the plug chamber, and wherein the plug chamber is configured to prevent rotation of the housings with respect to the shell.

18. The system of claim 1, wherein the axial displacement comprises movement along the longitudinal axis, and the angular displacement comprises rotation about the longitudinal axis.

19. The system of claim 1, wherein the plug chamber includes a groove, wherein the non-circular cross-section of the plug chamber is defined in part by the groove, wherein each housing includes an outer protrusion which defines a portion of the non-circular outer perimeter, wherein the outer protrusions are received in the groove, and wherein engagement between the groove and the outer protrusions prevents rotation of the housings with respect to the shell.

* * * * *